United States Patent [19]

Owsley et al.

[11] Patent Number: 4,737,080

[45] Date of Patent: Apr. 12, 1988

[54] VALVE ASSEMBLY

[75] Inventors: Herbert B. Owsley, Shawnee, Kans.; Lauren D. Sperry, Blue Springs, Mo.; James S. Bunn, Shawnee, Kans.

[73] Assignee: Ball Valve Company, Olathe, Kans.

[21] Appl. No.: 931,608

[22] Filed: Nov. 17, 1986

[51] Int. Cl.[4] ..... F04B 49/00

[52] U.S. Cl. ..... 417/275; 417/276; 417/277; 251/25; 251/30.01

[58] Field of Search ..... 417/275, 276, 277; 251/25, 30.01

[56] References Cited

U.S. PATENT DOCUMENTS

| | | | |
|---|---|---|---|
| 851,262 | 4/1907 | Tatum | 92/13.7 |
| 1,519,478 | 12/1924 | Beaton | 92/60.5 |
| 1,625,681 | 4/1927 | Prellwitz | 417/275 |
| 1,655,163 | 1/1928 | Ritter | 417/268 |
| 1,870,956 | 8/1932 | McAllister | 417/277 |
| 1,969,706 | 8/1934 | Hirsch | 417/274 |
| 2,833,462 | 5/1958 | Scheerer | 92/60.5 |
| 3,045,892 | 7/1962 | White | 417/274 |
| 3,972,652 | 8/1976 | Minnicino | 417/277 |
| 4,384,826 | 5/1983 | Gregg | 417/275 |
| 4,480,965 | 11/1984 | Ishizuka | 417/274 |

FOREIGN PATENT DOCUMENTS

| | | | |
|---|---|---|---|
| 259907 | 7/1927 | United Kingdom | 417/277 |

*Primary Examiner*—A. Michael Chambers

*Attorney, Agent, or Firm*—Litman, McMahon & Brown

[57] ABSTRACT

A valve assembly is provided which includes a seat structure and a cage structure. A valve member is movable between open and closed positions and includes an upstream side adapted to engage the seat structure with the valve member in its closed position and a downstream side connected to the cage struture. The cage structure includes a manifold communicating with the valve member downstream side. A pilot valve is provided for selectively venting the manifold to an area of low fluid pressure whereby the valve member is held in its open position.

17 Claims, 3 Drawing Sheets

Fig. 1.
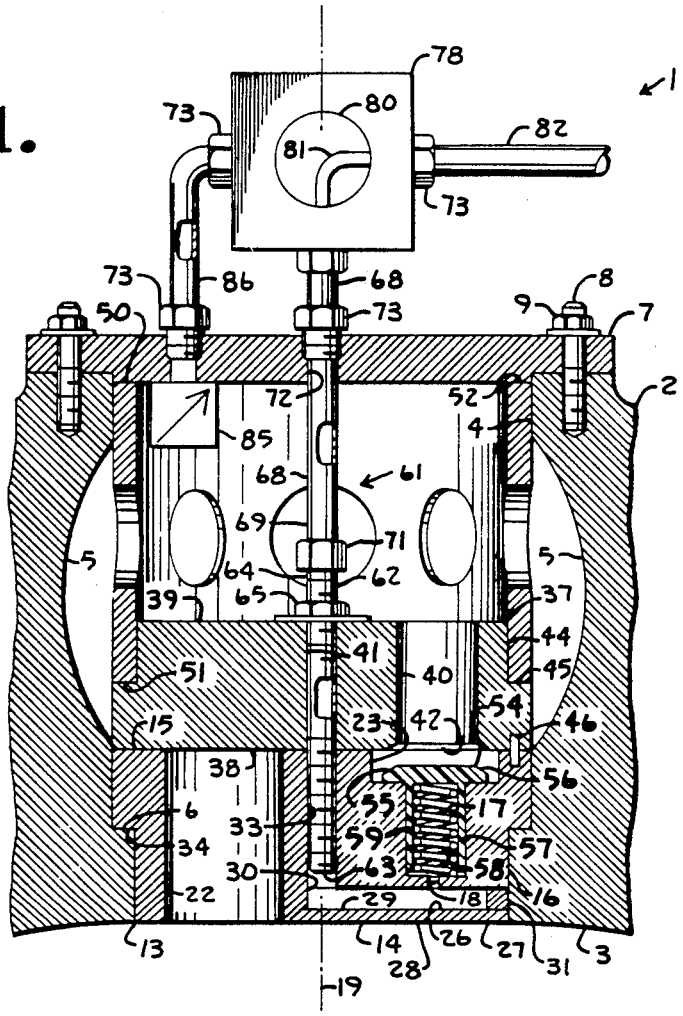
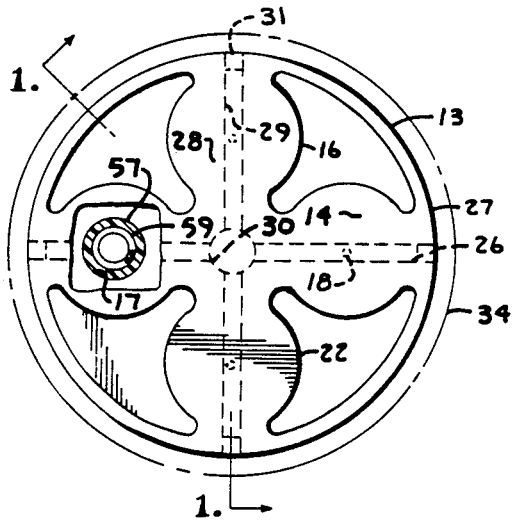
Fig. 2.
Fig. 3.
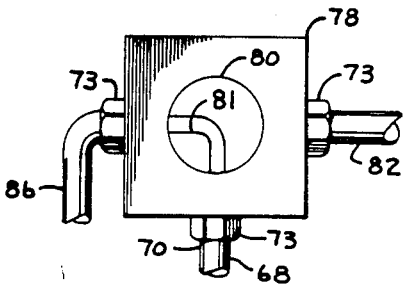

Fig. 5.
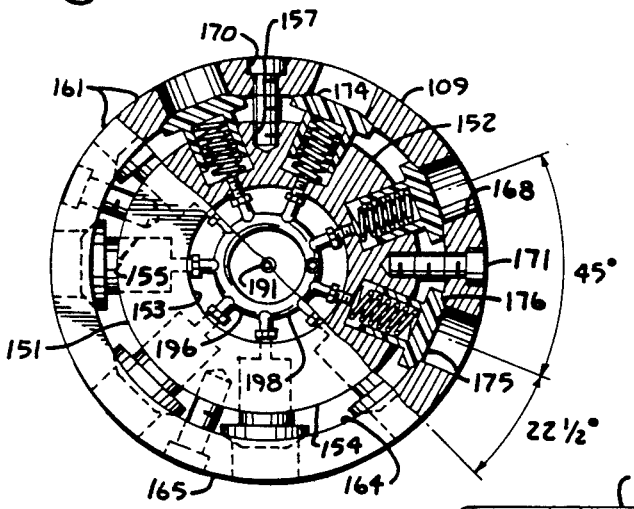
Fig. 6.
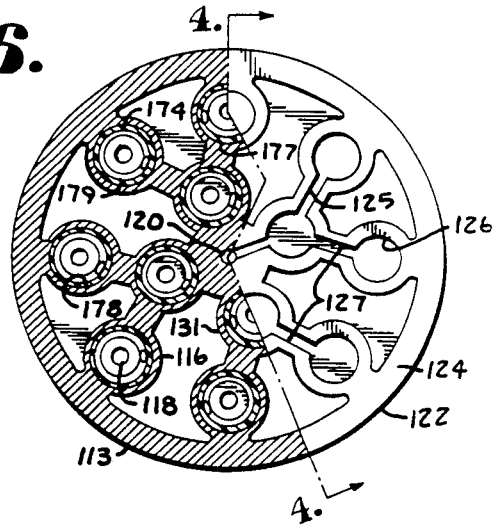
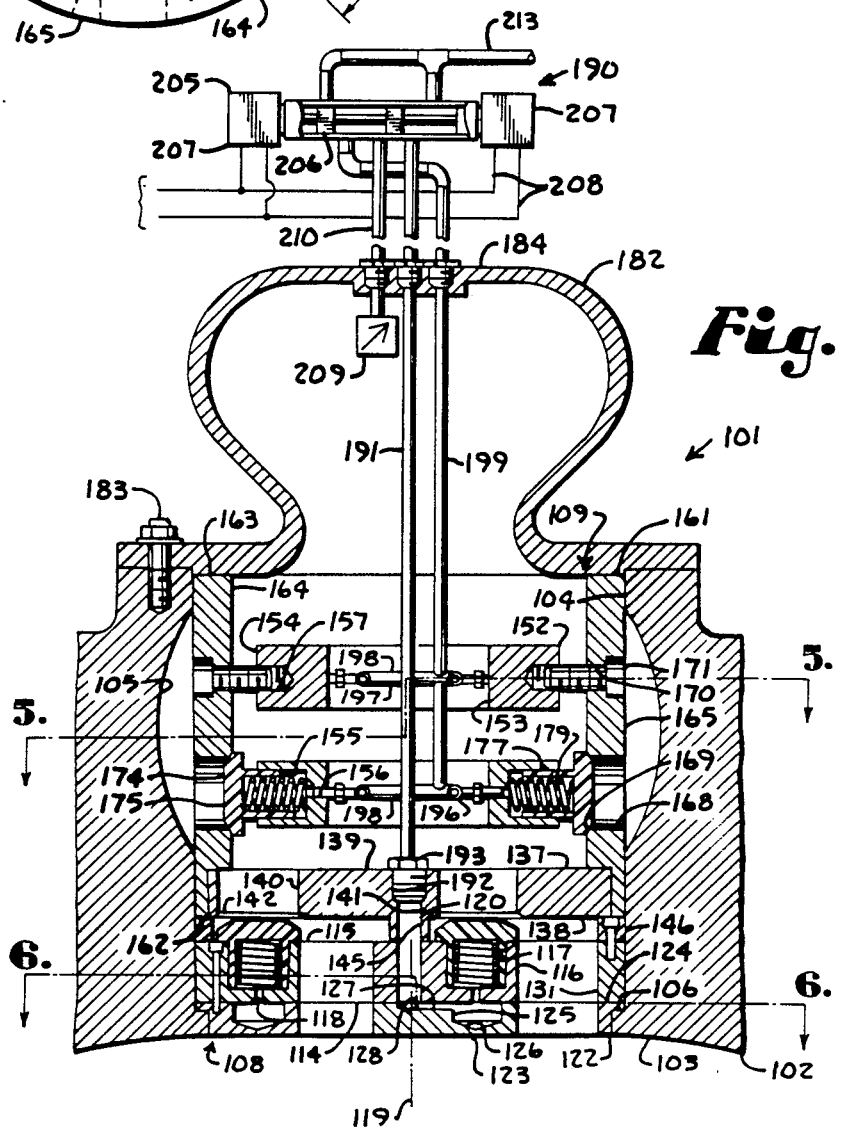
Fig. 4.

VALVE ASSEMBLY

BACKGOUND OF THE INVENTION

1. Field of the Invention

The present invention relates generally to valve assemblies, and in particular to a valve assembly wherein the valve members may be selectively held open to unload a compressor.

2. Description of the Prior Art

Valve assemblies are well known in the art and a variety of different designs have heretofore been proposed for the numerous applications where it is necessary to control fluid flow. In natural gas compressors, valve assemblies are often provided wherein the valve members are automatically opened by fluid pressure differential. Many of these natural gas compressors include pistons reciprocably mounted in cylinders and are capable of compressing large quantities of natural gas for transportation through pipelines over substantial distances. In the United States, extensive networks of natural gas pipelines extend from the production fields to the customers and include numerous compressor stations whereat the natural gas is compressed and advanced to the next compressor station or the customer.

The natural gas compressors are often driven by internal combustion engines fueled by natural gas taken directly from the pipeline. The engines and compressors generally have certain operating conditions at which they attain maximum efficiency with minimum energy consumption for the amount of natural gas compressed. These conditions include the compressor capacity, which is a function of displacement and clearance volume, and engine speed. Since the engines often have optimum efficient operating speeds at which they run constantly in the compressor stations, controlling the compressor output often involves controlling the clearance volume.

A compressor can be partly unloaded and its output decreased by increasing the clearance volume. Clearance bottles with valve arrangements for communicating them with the compressor cylinder are often provided for this purpose. Partial unloading can also be accomplished by closing off one or more of the suction valve assemblies with a device such as that shown in the Bunn et al. U.S. Pat. No. 4,447,193 which discloses a slidable piston for selectively closing the ports of a hollow sleeve to block the flow of gas from the suction chamber to the suction valve assembly.

Complete unloading of a compressor end can be accomplished by bypassing the suction valve assemblies and communicating the compressor cylinder directly with the suction chamber. For example, compressors can be unloaded by mechanically holding their valve members open. The Callan U.S. Pat. No. 1,275,843; the Haight U.S. Pat. No. 1,470,077 and the Redfield U.S. Pat. No. 1,505,604 all disclose valve assemblies with mechanical lifters—sometimes referred to as "fingers'—for mechanically holding the valve members in their open positions whereby a respective compressor end is completely unloaded because its cylinder communicates directly with the suction line and no compression can occur. Although they are generally effective for completely unloading a compressor end, such unloader arrangements have several disadvantages. First of all, for access to the valve members the lifters or fingers are generally placed directly in the fluid flow path, thus restricting fluid movement therethrough which decreases compressor efficiency. Another problem is that the lifters or fingers in many prior art compressor unloaders were susceptible to breakage, which could seriously damage a compressor and result in costly downtime.

A more reliable type of device for bypassing compressor suction valves is shown in the Bunn et al. U.S. Pat. No. 4,445,824. In the device shown therein, a ported tubular member selectively communicates the compressor cylinder with a suction chamber. A valve sleeve slidably receives the tubular member and selectively closes and opens its ports for loaded and unloaded operation respectively. Such an arrangement avoids the aforementioned problems with mechanical lifters or fingers because direct contact with the valve members is not required. However, the device shown in the Bunn et al. '824 patent is not adapted for partially unloading a compressor end, which is often desired for optimum compressor performance.

Both partial and complete unloading can be accomplished with a hybrid type of unloader assembly such as that shown in the Bunn et al. U.S. Pat. No. 4,043,710. Partial unloading is accomplished with a clearance bottle which is opened and closed with a valve member. Alternatively, the compressor end can be completely unloaded by moving a hollow sleeve to a position whereat the compressor cylinder communicates with the suction chamber so that no compression can occur.

The valve assembly of the present invention can be used to either partially or completely unload a compressor end.

SUMMARY OF THE INVENTION

In the practice of the present invention, a valve assembly is provided which includes a seat structure and a cage structure. A valve member is movable between open and closed positions and includes an upstream side adapted for engaging the seat structure with the valve member in its closed position. The valve member is connected to the cage structure. A manifold is provided in the cage structure and includes a fluid passage communicating with the valve member downstream side. A pilot valve selectively communicates the manifold with an area of relatively low fluid pressure whereby the valve member is held open or with an area of relatively high fluid pressure whereby the valve member operates normally.

In an alternative embodiment of the present invention, the valve assembly includes first and second valve subassemblies placed in series and adapted for being selectively held open whereby a compressor end may be: (1) partially unloaded with the downstream valve subassembly held open; (2) completely unloaded with both valve subassemblies held open; or (3) fully loaded with the upstream valve assembly held open.

OBJECT OF THE INVENTION

The principal objects of the present invention are: to provide a valve assembly with a manifold for holding open a valve member; to provide such a valve assembly wherein the manifold is formed in a cage structure thereof; to provide such a valve assembly wherein the valve member comprises a poppet with a stem reciprocably received in a bore in the cage structure; to provide such a valve assembly wherein the manifold includes a fluid passage communicating with the poppet stem bores; to provide such a valve assembly which includes an externally-mounted pilot valve; to provide such a valve assembly wherein the manifold is selectively vented to the atmosphere by the pilot valve; to provide such a valve assembly which includes first and second valve subassemblies positioned in series between a compressor cylinder and a suction line; to provide such a valve assembly wherein the valve subassemblies include respective valve members which may be selectively held open; to provide such a valve assembly wherein the valve subassemblies include separate manifolds for holding their respective valve members open; to provide such a valve assembly which is associated with a clearance bottle; to provide such a valve assembly which is adapted for causing a compressor end to operate in a partially loaded condition, a fully loaded condition and an unloaded condition; to provide such a valve assembly which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a partial, vertical, cross-sectional view of a compressor with a single deck valve assembly embodying the present invention taken generally along line 1—1 in FIG. 2.

FIG. 2 is a bottom plan view of the valve assembly.

FIG. 3 is a partial, side elevational view of a pilot valve shown in a position for loading the compressor end.

FIG. 4 is a partial, vertical, cross-sectional view of a compressor with a valve assembly comprising a modified embodiment of the invention and taken generally along line 4—4 in FIG. 6.

FIG. 5 is a horizontal, cross-sectional view of the valve assembly taken generally along line 5—5 in FIG. 4.

FIG. 6 is a horizontal, cross-sectional view of the valve assembly taken generally along line 6—6 in FIG. 4.

DETAILED DESCRIPTION OF THE INVENTION

Figure 7:
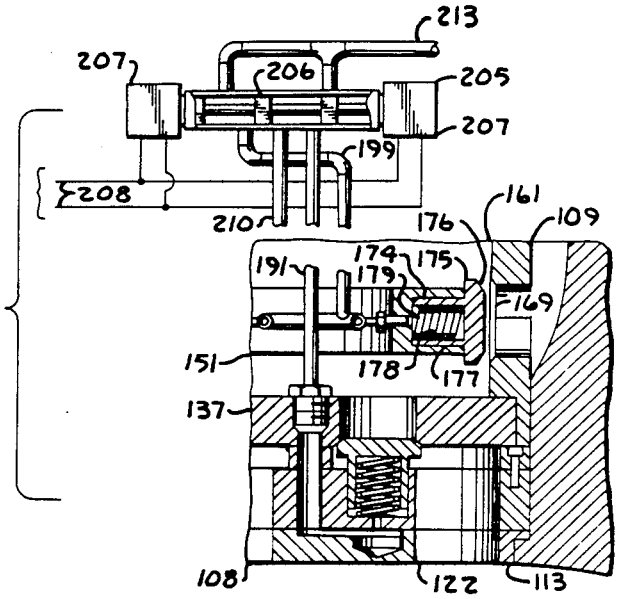
FIG. 7 is a fragmentary, vertical cross-sectional view of the valve assembly showing a pilot valve and valve members in positions for fully loaded operation.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates a valve assembly embodying the present invention. The valve assembly 1 comprises part of a compressor 2 with a cylinder 3 which receives a reciprocating piston (not shown). A suction valve pocket 4 is formed at one end of the cylinder 3 and communicates with a suction line 5 which in turn communicates with a fluid source, for example a natural gas pipeline. The valve pocket 4 includes an annular shoulder 6 and is closed by a valve cover 7 secured by threaded studs 8 and nuts 9.

The valve assembly 1 includes a cage structure 13 with a plurality of interconnected, somewhat cylindrical bosses 16 with poppet stem bores 17 and vent passages 18. The bosses 16 are positioned at 90° radial intervals with respect to a central axis 19 of the valve assembly 1. Cage voids 22 are formed between the bosses 16 and communicate with the compressor cylinder 3. The cage structure 13 includes inboard and outboard sides 14, 15 respectively. Each boss includes a poppet head receiver 23 in alignment with the bore 17 and vent passage 18; each receiver 23 communicating with respective voids 22 on either side thereof.

The cage structure 13 includes an integral manifold assembly 27 at its inboard side 14. The manifold assembly 27 includes a plate 28 corresponding to the configuration of the bosses 16, four lateral collectors 29 extending radially outwardly into respective bosses 16 at 90° intervals and each terminating at a manifold collector plug 131. The lateral collectors 29 and a hub 30 on the valve assembly central axis 19 form a manifold 26. A threaded stud receiver 33 extends along the central axis 19 from the outboard side 15 to the hub 30. The cage structure 13 includes an annular shoulder 34 adapted to engage the valve pocket shoulder 6 with the cage structure 13 properly positioned in the valve pocket 4.

A seat structure 37 including inboard and outboard sides 38, 39 is mounted on the cage outboard side 15 and includes four inlet passages 40 extending between the sides 38, 39 in alignment with respective poppet head receivers 23 in the cage structure 13. An unthreaded stud receiver 41 extends along the central axis 19 between the sides 38, 39 and aligns with the cage stud receiver 33.

An annular recess 44 between the seat structure sides 38, 39 defines a shoulder 45. The cage structure and seat structures 13, 37 are aligned by means of locating pins 46. At the seat structure inboard side 38, each inlet passage 40 terminates at a beveled valve seat 42.

A chair 50 with inboard and outboard ends 51, 52 is placed in the valve pocket 4 with its inboard end 51 abutting the seat structure shoulder 45 and its outboard end 52 abutting the valve cover 7. The chair 50 includes a plurality of circumferentially-spaced ports which communicate with the suction line 5.

The valve assembly 1 includes four poppet valve members 54, hereinafter referred to as "poppets". Each poppet 54 has a head 55 with an annular, beveled seating surface 56 and a stem 57 with a bore 58. The stem 57 is slidably received in a respective cage bore 17 with a return spring 59 positioned therein for urging the poppet 54 to its closed position with its seating surface 56 engaging a respective valve seat 42.

A vent system 61 is provided for unloading the compressor 2 and includes a hollow, threaded stud 62 which is threadably received in the cage structure stud receiver 33 and slidably received in the seat structure stud receiver 41. An inboard end 63 of the threaded stud 62 is located in proximity to the manifold hub 30 and an outboard end 64 projects beyond the seat structure outboard side 39 and threadably receives a nut 65 whereby the valve assembly 1 is clamped together with its cage structure and seat structures 13, 37 in predetermined alignment with each other.

A hollow connector tube 68 with inboard and outboard ends 69, 70 is joined at its inboard end 69 to the threaded stud outboard end 64 by a union 71. The connector tube outboard end 70 projects beyond the valve cover 7 through a threaded receiver 72 extending therethrough along the central axis 19 and is secured in a fluid-tight connection by a fitting 73.

A pilot valve 78 is connected to the connector tube 68 by a fitting 73 and includes a rotatable diverter 80 defining a fluid passage 81. The diverter 80 is movable between an unloaded position (FIG. 1) whereat the manifold 26 communicates with a low pressure vent line 82 and a loaded position (FIG. 3) whereat the manifold 26 communicates with a check valve 85 positioned in the valve pocket 4 and connected to the pilot valve 78 by a check valve line 86. The lines 82, 86 are connected to the pilot valve 78 and the valve cover 7 by fittings 73.

In operation, the pilot valve diverter 80 is moved to its position as shown in FIG. 1 whereat it communicates the manifold 26 with the vent line 82. The pilot valve 78 may be actuated manually or by any appropriate automatic actuator. For example, the compressor 2 may include a control system which actuates the pilot valve 78 electrically, pneumatically or hydraulically when certain operating conditions are encountered which require unloading an end of the compressor 2.

The vent line 82 can vent to the atmosphere or some other area with pressure considerably lower than that present in the suction line 5. The pressure differential between the compressor cylinder 3 and the suction line 5 across the valve assembly 1 causes the poppets 54 to move to their open positions as shown in FIG. 1 with their heads 55 engaging the cage structure 13 within respective poppet head receivers 23. Thus opened, the poppets 54 are retained in their open positions by the pressure differential between the compressor cylinder 3 and the manifold 26. If necessary, the vent line 82 can be connected to a pump for evacuating the fluid in the manifold 26 whereby the partial vacuum thus created will pull the poppets 54 to their open positions.

After the poppets 54 are moved to their open positions as shown in FIG. 1, the pressure differential between the compressor cylinder 3 and the manifold 26 is such that they will remain in their open positions indefinitely even though the pressure in the compressor cylinder 3 may fluctuate as the compressor piston reciprocates.

When normal operation is desired, the pilot valve 78 is moved to its loaded operation position as shown in FIG. 3 whereby pressurized fluid from the suction line 5 is admitted through the check valve 85 to the manifold 26. The poppets 54 are biased by the fluid pressure in the manifold 26 and their return springs 59 to their closed positions and normal operation of the valve assembly 1 is restored.

The check valve 85 prevents reverse fluid flow from the compressor cylinder 3 to the suction line 5. When the pilot valve diverter 80 is moved to its position as shown in FIG. 3, the check valve 85 admits fluid into the manifold 26, the threaded stud 62, the connector tube 68 and the check valve line 86 whereby the poppets 54 are immediately released from the partial vacuum created within these passages and the valve assembly 1 operates normally. The check valve 85 permits small amounts of fluid to flow from the suction line 5, through these passages, around the poppet valve stems 57 and into the compressor cylinder 3 when the poppets 54 are open.

The manifold assembly 27 cooperates with the poppet valve members 54 to enhance the operation of the valve assembly 1. For unloaded operation, the manifold assembly 27 provides a partial vacuum to hold the poppet valve members 54 open by differential pressure so that no mechanical device or apparatus is placed in the path of fluid flow between the cylinder 3 and the suction line 5. Hence fluid flow is substantially unimpeded through the valve assembly 1. During normal, loaded operation the absence of mechanical poppet-opening devices facilitates the free flow of fluid through the valve assembly 1. Such unimpeded fluid flow is an important factor in maintaining compressor efficiency. The use of a partial vacuum and a pressure differential for accomplishing the unloading is also preferred to mechanical devices because there is less chance of malfunction and fewer moving parts are required inside the valve assembly which could break off and damage the compressor.

A multi-stage valve assembly comprising a first modified embodiment of the present invention is shown in FIGS. 4–8 and is generally designated by the reference numeral 101. The valve assembly 101 comprises part of a compressor 102 with a cylinder 103 having a valve pocket 104 at one end thereof in communication with a suction line 105. The valve pocket 104 includes an annular shoulder 106. The composite valve assembly 101 generally comprises a single deck valve subassembly 108 and a double deck, annular valve subassembly 109 in series between the suction line 105 and the compressor cylinder 103.

The single deck valve subassembly 108 comprises a cage structure 113 with inboard and outboard sides 114, 115. The cage structure 113 includes twelve interconnected, cylindrical bosses 116 each having a poppet stem bore 117 open at the outboard side 115 and a smaller diameter vent 118 open at the cage structure inboard side 114. The bores 117 and the vent passages 118 associated therewith are aligned along axes which extend parallel to a central axis 119 of the valve assembly 101. The cage structure 113 includes a central bore 120 along the central axis 119.

A manifold assembly 122 with inboard and outboard sides 123, 124 is mounted on the cage structure inboard side 114. The manifold assembly 122 includes a manifold 125 open at the outboard side 124 and comprising a plurality of manifold pockets 126 aligned with respective bores 117 and vent passages 118 interconnected by manifold channels 127. The channels 127 radiate outwardly from a manifold hub 128 which is located on the central axis 119 in communication with the control bore 120. A plurality of voids 131 are formed between the cage structure bosses 116 and through the manifold assembly 122 for communicating fluid from the cage structure outboard side 115 to the manifold assembly inboard side 123.

A seat structure 137 with inboard and outboard sides 138, 139 includes twelve inlet passages 140 extending from the outboard side 139 and terminating at respective beveled valve seats 142 at the seat structure inboard side 138. The seat structure 137 includes a threaded central bore 141. The cage structure outboard side 115 and the seat structure inboard side 138 are separated by inner and outer extensions 145, 146 of seat structure 137.

The annular valve subassembly 109 includes inboard and outboard cage structures 151, 152 each having inner and outer annular surfaces 153, 154. Eight poppet stem bores 155 extend radially inwardly from each outer surface 154 and communicate with respective vent passages 156 which extend radially inwardly to the respective inner surface 153. Four threaded receivers 157 also extend radially inwardly into each cage structure 151, 152 from its outer surface 154 at approximately 90° intervals between respective bores 55.

A tubular seat structure 161 includes inboard and outboard ends 162, 163 and inner and outer annular surfaces 164, 165. The seat structure 161 includes a total of sixteen inlet passages 168 extending from the outer surface 165 to respective valve seats 169 at the inner surface 164 arranged in two annular rows of eight passages 168 each and radially spaced at 45° intervals. The two annular rows of inlet passages 168 are staggered 22½° with respect to each other as shown in FIG. 5.

A total of eight countersunk mounting bolt receivers 170 positioned opposite the cage structure receivers 157 Corresponding mounting bolts 171 are positioned in respective, aligned receivers 157, 170 and secure the cage structures 151, 152 in proper position within the valve pocket 104. Since each cage structure 151, 152 is secured in place by four mounting bolts 171, it can be precisely centered within the seat structure 161 by fine adjustments with the mounting bolts 171.

The multi-stage valve assembly 101 includes a total of twenty-eight poppet valve members 174; twelve in the single deck subassembly 108 and sixteen in the annular valve subassembly 109. Each poppet valve member 174 includes a head 175 with an annular, beveled seating surface 176 adapted to engage a respective valve seat 142 or 169. Poppet valve stems 177 are reciprocably positioned within respective valve member bores 117 and 155 and include valve stem bores 178 which receive return springs 179 for urging the poppet valve members 174 towards their closed positions.

A clearance bottle 182 is mounted on the end of the compressor 102 over the valve pocket 104 by bolts 183. The clearance bottle 182 engages the seat structure outboard end 163 for holding it tightly against the seat structure 137, the extensions 145, 146, the cage structure 113 and the manifold assembly 122. The clearance bottle 182 communicates with the interior of the annular valve subassembly 108 and includes an outboard end 184.

A vent system 190 is provided for opening the valve subassemblies 108, 109 and includes a single deck valve assembly connector tube 191 positioned on the central axis 119 and communicating with a vent bore 192 through the cage structure 113, the inner extension 145 and the seat structure 137. The vent bore 192 threadably receives a fitting 193 in the seat structure 137 whereby it is connected to the connector tube 191. The connector tube 191 extends through the clearance bottle outboard end 184 and is sealed thereat with a fitting 193.

Inboard and outboard annular vent manifolds 196, 197 are positioned within the cage structure inner perimeters 153 respectively. Radial collectors 198 extend laterally from the vent manifolds 196, 197 and are connected to respective cage structures 151, 152 in communication with respective vents 156 by fittings 193. An annular valve subassembly connector tube 199 communicates with the annular valve subassembly vent manifolds 196, 197 and extends through the clearance bottle outboard end 184 to which it is connected by a fitting 193.

A three-way pilot valve 205 controls the operation of the multi-stage valve assembly 101 and includes a valve spool 206 which is reciprocated by solenoids 207 connected by lead wires 208 to a control system (not shown). The pilot valve 205 is connected to a check valve 209 by a connector tube 210 extending through the clearance bottle outboard end 184 at a fitting 193. A low pressure vent line 213 is connected to each end of the pilot valve 205 and communicates with the atmosphere or a low pressure area. Between the check valve connector tube 110 and the low pressure vent line 213, the pilot valve 205 is connected to the connector tubes 191, 199 for the single deck and annular valve subassemblies 108, 109 respectively.

In operation, with the valve spool 206 of the pilot valve 205 in its right hand position as shown in FIG. 4, the manifold 125 of the single deck valve subassembly communicates with the low pressure vent line 213 whereby the respective poppet valve members 174 in the single deck valve subassembly 108 are drawn to their open positions by the partial vacuum created within the manifold 125. The manifolds 196, 197 of the annular valve subassembly 109 receive pressurized fluid from the clearance bottle 182 which is in communication with the compressor cylinder 103. The pressurized fluid in cooperation with the return springs 179 urges respective poppet valve members 174 to their closed positions, from which they are lifted on each suction stroke of the compressor by differential fluid pressure across the annular valve subassembly 109, which operates in the normal manner. In this condition, the end of the compressor 102 is partially unloaded because the volume of the clearance bottle 182 and the valve pocket 104 are added to the clearance volume at the end of the compressor 102.

With the pilot valve spool 206 moved to its left hand position as shown in FIG. 7, the manifolds 196, 197 of the annular valve subassembly 109 are connected to the low pressure vent line 213 whereby the respective poppet valve members 174 of the annular valve subassembly 109 are held in their open positions. The manifold 125 of the single deck valve subassembly 108 communicates with the clearance bottle 182 and the suction line 105. In this configuration, the volume of the valve pocket 104 and the volume of the clearance bottle 182 are merely added to that of the suction line 105, and the compressor end operates in its fully loaded condition with only the single deck valve subassembly 108 operational.

Figure 8:
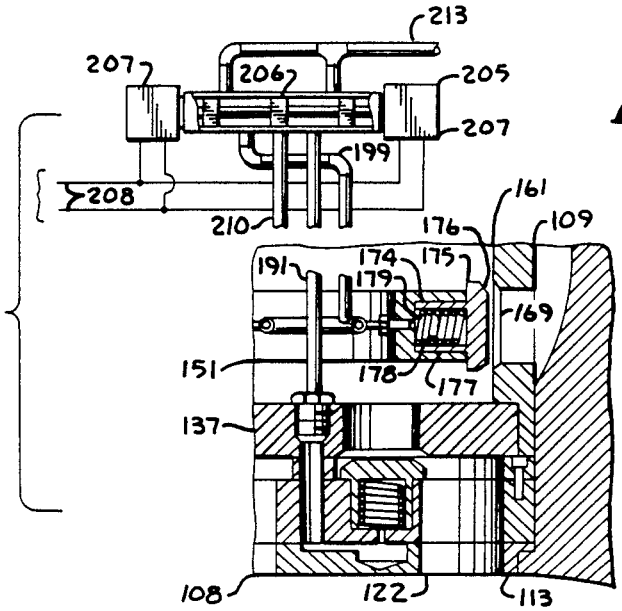
FIG. 8 is a fragmentry, vertical cross-sectional view of the valve assembly showing a pilot valve and the valve members in positions for fully unloaded operation.

With the pilot valve spool 206 in its middle position as shown in FIG. 8, all of the manifolds 125, 196 and 197 communicate with the low pressure vent line 213 and all of the poppet valve members 174 are held open whereby the entire multi-stage valve assembly 101 is opened and the end of the compressor 102 is unloaded by communicating its cylinder 103 directly with the suction line 105.

It will be appreciated that a pilot valve assembly could be provided that would render both valve subassemblies 108, 109 operative in series, but normally this is not required and the three operational phases discussed above, i.e. partially loaded, fully loaded and unloaded, are preferred.

It is to be understood that while certain forms of the present invention have been illustrated and described herein, it is not to be limited to the specific forms or arrangement of parts described and shown.

What is claimed and desired to be secured by Letters Patent is as follows:

1. A suction valve assembly including upstream and downstream sides, said upstream side communicating with a compressor suction line and said downstream side communicating with a compressor cylinder, which includes:

(a) a first valve subassembly including:
(1) a seat structure;
(2) a cage structure mounted on said seat structure;
(3) a valve member movable between open and closed positions and having an upstream side engaging said seat structure in its closed position and a downstream side; and
(4) a manifold associated with said cage structure and communicating with said valve member downstream side;

(b) a second valve subassembly including:
(1) a seat structure;
(2) a cage structure mounted on said seat structure;
(3) a valve member movable between open and closed positions and having an upstream side engaging said seat structure in its closed position and a downstream side; and
(4) a manifold associated with said cage structure and communicating with said valve member downstream side;

(c) said first and second valve subassemblies being positioned in series between said valve assembly upstream and downstream sides; and (d) a pilot valve having a first position communicating said first valve subassembly manifold with an area of relatively low fluid pressure whereby said first valve member is opened, a second position communicating said second valve subassembly manifold with an area of relatively low fluid pressure whereby said second valve member is opened and a third position communicating both of said manifolds with an area of relatively low fluid pressure whereby both of said valve members are opened.

2. The valve assembly according to claim 1, which includes:

(a) said first valve subassembly having a poppet valve member with a head at said upstream side and a stem extending from said head at said downstream side;

(b) said cage structure of said first valve subassembly having a poppet stem bore reciprocably receiving said poppet stem; and (c) said manifold communicating with said poppet stem bore.

3. The valve assembly according to claim 2, which includes:

(a) said cage structure of said first valve subassembly having a vent passage with a narrower diameter than said poppet stem bore, said vent passage extending between said manifold and said poppet stem bore.

4. The valve assembly according to claim 3, which includes:

(a) said first valve subassembly having a plurality of said poppet valve members and a plurality of said poppet stem bores and vent passages; and (b) said manifold comprising a plurality of manifold fluid passages communicating with said vent passages.

5. The poppet valve assembly according to claim 4, which includes:

(a) a central bore extending through said cage structure and seat structures of said first valve assembly and communicating with said manifold.

6. The valve assembly according to claim 5, which includes:

(a) a hollow, threaded stud extending through said central bore and threadably received in one of said seat structure and said cage structure of said first valve subassembly, said hollow stud being in communication with said manifold.

7. The valve assembly according to claim 2 wherein:

(a) said second valve subassembly includes an annular seat structure and a poppet valve member with a head at said upstream side and a stem extending from said head at said downstream side;

(b) said cage structure of said second valve subassembly having a poppet stem bore reciprocably receiving said poppet stem; and (c) said manifold of said second valve subassembly communicating with said poppet stem bore.

8. The valve assembly according to claim 7, wherein:

(a) said second valve subassembly includes a plurality of valve seats on said seat structure, said valve seats being located inboard and outboard annular rows;

(b) said second valve subassembly includes inboard and outboard cage structures each positioned opposite a respective annular row of valve seats; and (c) a plurality of poppets reciprocably mounted on said cage structures and adapted for selectively engaging said valve seats.

9. The valve assembly according to claim 1 wherein:

(a) said pilot valve in its first position communicates said second valve subassembly manifold with an area of relatively high fluid pressure; and (b) said pilot valve in its second position communicates said first first valve subassembly manifold with said area of relatively high fluid pressure.

10. The valve assembly according to claim 9, which includes:

(a) a check valve adapted for permitting one-way fluid flow from said area of relatively high fluid pressure to said pilot valve.

11. A suction or discharge valve assembly including a first side communicating with a fluid line and second side communicating with a compressor cylinder, which comprises:

(a) a valve subassembly including:
(1) a cage structure with a valve stem bore and a vent passage extending therefrom;
(2) a manifold including a fluid passage communicating with said cage structure vent passage;
(3) a void extending through the cage structure and communicating with one of the valve assembly sides; and
(4) a seat structure communicating with the other valve assembly side and including an inlet passage terminating at a valve seat and selectively communicating with said cage structure void;

(b) a poppet valve member having open and closed positions and including a head adapted for a selectively engaging said valve seat with said valve member in its closed position and a stem slidably received in said valve stem bore; and (c) a vent system including:

(1) a pilot valve selectively communicating with one of said fluid line and a low fluid pressure area;

(2) means communicating said manifold fluid passage with said pilot valve; and (3) said pilot valve having a first position communicating said manifold fluid passage with said low pressure area and a second position communicating said manifold fluid passasge with said fluid line, said poppet valve member being held in its open position with said pilot valve in its first position.

12. The valve assembly according to claim 11, which includes:

(a) said valve assembly comprising a suction valve assembly and said fluid line comprising a suction line.

13. The valve assembly according to claim 11, which includes:

(a) said valve assembly comprising a discharge valve assembly and said fluid line comprising a discharge line.

14. The valve assembly according to claim 11, which includes:

(a) a central bore extending through said seat structure and cage structures and communicating with said manifold fluid passage.

15. The valve assembly according to claim 14, which includes:

(a) a hollow, threaded stud extending through said central bore and threadably received in one of said seat structure and said cage structure, said hollow stud being in communication with said fluid passage.

16. The valve assembly according to claim 14, which includes:

(a) a plurality of said poppets;

(b) a plurality of said poppet stem bores;

(c) said manifold including a plurality of said fluid passages;

(d) a plurality of said vent passages each communicating a respective poppet stem bore and fluid passage; and (e) each said fluid passage communicating with said central bore.

17. A valve assembly including an upstream side communicating with a suction line and a downstream side communicating with a compressor cylinder, which comprises:

(a) a single deck valve subassembly including:

(1) a cage structure with a plurality of valve stem bores and respective vent passages coaxial therewith;

(2) a manifold assembly with a plurality of channels communicating with said cage structure vent passages and a central hub;

(3) a plurality of voids extending through said cage structure and said manifold assembly and communicating with said compressor cylinder;

(4) a seat structure including a plurality of inlet passages each terminating at a respective valve seat, said inlet passages selectively communicating with respective voids; and (5) a central bore extending along a central axis through said cage structure and said seat structure and communicating with said manifold hub;

(b) an annular valve subassembly including:

(1) an annular cage structure with inner and outer annular surfaces, a plurality of valve stem bores extending radially inwardly from said outer surface and communicating with respective vent passages which extend to said inner surface;

(2) a manifold assembly comprising an annular vent manifold having a plurality of radially-extending collector tubes communicating with respective vent passages at said cage structure inner surface;

(3) a seat structure including inner and outer surfaces and a plurality of inlet passages extending therebetween from said suction line at said seat structure outer surface to respective valve seats at said seat structure inner surface; and (4) mounting means adapted for mounting said cage structure within said seat structure with said cage structure outer surface in spaced relation from said seat structure inner surface and said cage structure bores in radial alignment with respective seat structure inlet passages; and (c) a plurality of poppet valve members each including a respective head adapted for selectively engaging a respective valve seat and a stem slidably received in a respective valve stem bore;

(d) a clearance bottle mounted on said compressor in communication with said valve pocket, said clearance bottle having an outboard end;

(e) a vent system including:

(1) a single deck valve subassembly connector tube communicating with said single deck valve subassembly central bore and extending through said clearance bottle outboard end;

(2) an annular valve subassembly connector tube connected to said vent manifold and extending through said clearance bottle outboard end;

(3) a check valve positioned within said clearance bottle and adapted for permitting one-way fluid flow from said clearance bottle;

(4) a low pressure vent line; and (5) a pilot valve connected to said connector tubes, said check valve and said low pressure vent line, said pilot valve having a first position connecting said single deck valve subassembly connector tube with said low pressure vent line and said annular valve subassembly connector tube with said check valve, a second position connecting said annular valve subassembly connector tube with said low pressure vent line and said single deck valve subassembly with said check valve; and a third position connecting said single deck and annular valve subassembly connector tubes with said low pressure vent line;

(f) said poppet valve members in said single deck valve subassembly being held in their open positions with said pilot valve in its first position;

(g) said poppet valve members in said annular valve subassembly being held in their open positions with said pilot valve in its second position; and (h) said poppet valve members in both said single deck and annular valve subassemblies being held in their open positions with said pilot valve in its third position.

* * * * *